US006863596B2

(12) United States Patent
Fritz et al.

(10) Patent No.: US 6,863,596 B2
(45) Date of Patent: Mar. 8, 2005

(54) ABRASIVE ARTICLE

(75) Inventors: Peter J. Fritz, Minneapolis, MN (US); Chong Soo Lee, Woodbury, MN (US); James W. Malaske, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/865,947

(22) Filed: May 25, 2001

(65) Prior Publication Data

US 2002/0177391 A1 Nov. 28, 2002

(51) Int. Cl.[7] ..... B24B 1/00
(52) U.S. Cl. ..... 451/59; 451/342
(58) Field of Search ..... 451/59, 342, 340, 451/343, 460, 465, 466, 359, 544; 83/561

(56) References Cited

U.S. PATENT DOCUMENTS

| | | | | |
|---|---|---|---|---|
| 1,221,145 | A | | 2/1917 | Block et al. |
| 1,869,564 | A | | 8/1932 | Johnston |
| 2,156,002 | A | | 4/1939 | Tinnerman |
| 2,331,861 | A | | 10/1943 | Smith |
| 2,781,618 | A | | 2/1957 | Larson |
| 2,958,593 | A | | 11/1960 | Hoover et al. |
| 3,274,638 | A | | 9/1966 | Bien |
| 3,561,938 | A | | 2/1971 | Block et al. |
| 3,574,978 | A | | 4/1971 | Block |
| 3,616,581 | A | | 11/1971 | Johnson et al. |
| 3,667,169 | A | | 6/1972 | MacKay, Jr. |
| 3,765,130 | A | | 10/1973 | Block |
| 3,883,998 | A | | 5/1975 | Dosser |
| 4,015,371 | A | | 4/1977 | Grayston |
| 4,245,438 | A | | 1/1981 | van Buren, Jr. |
| 4,263,755 | A | | 4/1981 | Globus |
| 4,311,489 | A | | 1/1982 | Kressner |
| 4,314,827 | A | | 2/1982 | Leitheiser et al. |
| 4,322,920 | A | * | 4/1982 | Wells ..... 451/342 |
| 4,439,907 | A | | 4/1984 | Block et al. |
| 4,439,953 | A | | 4/1984 | Block et al. |
| 4,518,397 | A | | 5/1985 | Leitheiser et al. |
| 4,543,107 | A | | 9/1985 | Rue |
| 4,588,419 | A | | 5/1986 | Caul et al. |
| 4,623,364 | A | | 11/1986 | Cottringer et al. |
| 4,637,170 | A | | 1/1987 | Block |
| 4,652,275 | A | | 3/1987 | Bloecher et al. |
| 4,655,006 | A | | 4/1987 | Block |
| 4,679,360 | A | | 7/1987 | Eisenblatter |
| 4,683,683 | A | | 8/1987 | Block |
| 4,718,204 | A | | 1/1988 | Eisenblatter |
| 4,734,104 | A | | 3/1988 | Broberg |
| 4,737,163 | A | | 4/1988 | Larkey |
| 4,744,802 | A | | 5/1988 | Schwabel |
| 4,751,138 | A | | 6/1988 | Tumey et al. |
| 4,754,577 | A | | 7/1988 | MacKay, Jr. |
| 4,760,670 | A | | 8/1988 | MacKay, Jr. |
| 4,770,671 | A | | 9/1988 | Monroe et al. |

(List continued on next page.)

FOREIGN PATENT DOCUMENTS

WO WO 01/08849 A1 2/2001

OTHER PUBLICATIONS

3M Brochure entitled "Grindline Express, Coated Abrasive, Surface Conditioning and Superabrasives Products", Abrasive Systems Division, 60–4400–0168–7 (399) JR, 1999.

*Primary Examiner*—Dung Van Nguyen
(74) *Attorney, Agent, or Firm*—Gregory D. Allen; Rick L. Franzen

(57) ABSTRACT

Abrasive article including a backing plate. Backing plate has a first major surface and a second opposite major surface. A central aperture extends through backing plate. An abrasive layer is secured to the first major surface of backing plate. A fastener is press fit to backing plate so as to define the central aperture.

21 Claims, 3 Drawing Sheets

U.S. PATENT DOCUMENTS 4,799,939 A 1/1989 Bloecher et al.
4,881,951 A 11/1989 Monroe et al.
4,890,422 A * 1/1990 Reiling et al. ..... 451/342
4,896,463 A 1/1990 MacKay, Jr.
5,011,508 A 4/1991 Wald et al.
5,090,968 A 2/1992 Pellow
5,139,978 A 8/1992 Wood
5,201,149 A 4/1993 Eisenblatter
5,201,916 A 4/1993 Berg et al.
5,203,884 A 4/1993 Buchanan et al.
5,207,028 A 5/1993 Timmons
5,227,104 A 7/1993 Bauer
5,316,812 A 5/1994 Stout et al.
5,366,523 A 11/1994 Rowenhorst et al.
5,417,726 A 5/1995 Stout et al.
5,429,647 A 7/1995 Larmie
5,436,063 A 7/1995 Follett et al.
5,496,386 A 3/1996 Broberg et al.
5,498,269 A 3/1996 Larmie
5,551,963 A 9/1996 Larmie
5,573,619 A 11/1996 Benedict et al.
5,607,206 A 3/1997 Siddle et al.
5,669,941 A 9/1997 Peterson
5,707,275 A 1/1998 Preis et al.
5,722,881 A 3/1998 Emerson
D394,530 S 5/1998 Roeker
5,752,876 A 5/1998 Hettes
5,871,322 A 2/1999 Nakamura
5,871,399 A 2/1999 Emerson
5,938,514 A 8/1999 Amin et al.
5,951,389 A 9/1999 Hettes et al.
5,961,674 A 10/1999 Gagliardi et al.
6,095,910 A * 8/2000 Luedeke ..... 451/359

* cited by examiner

ABRASIVE ARTICLE

FIELD OF THE INVENTION

The present invention relates to an abrasive article including a backing plate and fastener press fit into the backing plate.

BACKGROUND OF THE INVENTION

A variety of abrasive articles are used to abrade or polish various substrates, including steel and other metals, woods, wood-like laminates, engineered boards, plastic, fiberglass, leather and ceramics. The abrasive articles are in any of a variety of forms, including sheets, discs, belts, wheels, and bands.

Many abrasive articles are used as discs in grinding assemblies. A typical abrasive sanding or grinding assembly includes: an annular back-up pad made from a resilient and reinforced material such as rubber or plastic and an abrasive disc having a backing plate and an abrasive surface (e.g., as provided by coated abrasive discs and non-woven abrasive discs) that includes abrasive material (e.g., abrasive grains and abrasive slurries). The abrasive disc and the back-up pad are typically mounted on a rotatable shaft of a tool and a retaining nut is used to secure the abrasive disc and back-up pad to the tool shaft. The shaft of the tool is inserted through holes in the center of the abrasive disc and back up pad. Frictional pressure is applied to the abrasive disc by screwing the nut onto the shaft to rotationally mount the disc to the back up pad by squeezing the abrasive disc against the back-up pad. In use, the shaft of the assembly is rotated and the abrasive surface of the disc is pressed against a substrate or workpiece with considerable force, to facilitate abrading of the substrate or workpiece. During the grinding process, the disc is subjected to severe stresses.

The abrasive material may completely cover or alternatively may only partially cover the surface of the backing plate. One particular style of abrasive disc uses an annular ring of abrasive material applied to the backing plate such that the inner radial boundary of the abrasive material is concentric with the backing plate. Examples of abrasive discs having an annulus of abrasive material include flap discs, non-woven surface conditioning discs, and grinding wheels.

The backing plates used in the abrasive articles (e.g., discs) are typically made of paper, certain polymeric materials such as phenolic impregnated fiberglass, cloth, non-woven materials, vulcanized fiber, or combinations of these materials. Many of these materials, however, are not appropriate for certain applications because they are not of sufficient strength, flexibility, or impact resistance. Further, some of these materials age too rapidly. In some instances the materials are sensitive to liquids which are used as coolants and cutting fluids. As a result, a short useful product life can occur in certain applications.

One common backing plate material is vulcanized fiber. Vulcanized fiber backing plates are typically heat resistant and strong, which are advantageous characteristics when the coated abrasive is used in a grinding operation that imposes severe conditions of heat and pressure. For example, vulcanized fiber is used in certain grinding operations, such as weld grinding, contour grinding, and edge grinding, wherein the coated abrasive can be exposed to temperatures greater than 140° C. Vulcanized fiber backing plates, however are expensive, as well as hygroscopic, and thus sensitive to humidity.

Under extreme conditions of humidity (i.e., conditions of high and low humidity) vulcanized fiber typically either expands or shrinks, due, respectively, to water absorption or loss. As a result, an abrasive article made of vulcanized fiber tends to cup, causing a coated abrasive disc to curl either in a concave or a convex fashion. When this cupping or curling occurs, the affected abrasive disc does not lay flat against the back-up pad or support pad. This can effectively render the abrasive disc not useful.

To overcome the cupping and curling problems, other types of backing plate materials have been used, such as phenolic reinforced fiber backing plates. While these backing plates were typically more resistant to cupping or curling, the use of this type of material has led to other problems (e.g., cracking).

It is desirable to design abrasive discs to be quickly and easily removable from the rotatable shaft. One common technique for securing an abrasive disc to the shaft is typically accomplished by screwing a nut onto the rotary shaft of a tool, (thereby compressing the disc onto the back up pad). It is typically necessary to use tools (e.g., wrenches) to loosen and tighten the nut every time it is desirable to change the abrasive disc. The time required to change the abrasive disc can significantly limit the efficiency of the grinding task. To address this problem, other fasteners have been used. Unfortunately, such fasteners have not been conducive to quick and easy mounting and removal.

For example, a phenolic reinforced backing plate has been utilized in combination with an insert bonded or attached to a center hole formed through the back up pad. Another example is a metal grommet or nut that is adhesively bonded or mechanically attached to the backing plate. The manufacturing methods for making commercially useful embodiments utilizing either of these two types of mounting arrangements is relatively expensive. In part this expense can be attributed to the difficulty in drilling or punching holes or riveting the insert or grommet into backing plate without cracking the relatively brittle backing plate.

When relatively flexible backing plate materials are used, the backing plate tends to undesirably curl or otherwise become misshapen. Further, it can be more difficult to adequately secure the fastener to the backing plate.

There is a continuing need to develop manufacturing processes which provide an abrasive disc having adequate strength to withstand relatively harsh grinding environments which can be easily manufactured and mounted to and unmounted from a tool.

SUMMARY OF THE INVENTION

In one aspect, the present invention provides an abrasive article comprising (a) a backing plate (e.g., generally circular backing plate) having a first major surface and a second, major surface opposite the first major surface, wherein the backing plate includes a central aperture extending therethrough, and wherein the backing plate comprises a thermoplastic binder material and fibrous reinforcing material, (b) an abrasive layer secured to the first major surface of the backing plate, and (c) a fastener press fitted to the backing plate so as to define the central aperture.

In another aspect the present invention provides a method of making an abrasive article comprising applying adhesive to a backing plate having a central aperture wherein the backing plate comprises a thermoplastic binder material and fibrous reinforcing material, disposing abrasive material onto the adhesive, disposing the backing plate onto a jig, disposing a fastener having tines so as to be concentric with the central aperture, and pushing the tines through the backing plate and folding the tines so as to fixably attach the fastener to the backing plate.

In another aspect, the present invention provides a method of abrading a surface, the method comprising:

providing an abrasive article comprising:

a backing plate having a first major surface and a second, major surface opposite the first major surface, wherein the backing plate includes a central aperture extending therethrough, and wherein the backing plate comprises a thermoplastic binder material and fibrous reinforcing material;

an abrasive layer secured to the first major surface of the backing plate; and a fastener press fitted to the backing plate so as to define the central aperture;

attaching the abrasive article to a shaft (e.g., a rotating shaft of a tool) through the central aperture of the abrasive article;

contacting at least a portion of the abrasive layer with a surface of a workpiece; and moving (e.g., rotating the shaft) the abrasive article relative to the surface of workpiece such that at least a portion of the workpiece is abraded by at least a portion of the abrasive layer.

BRIEF DESCRIPTION OF THE DRAWINGS

The present invention will be further explained with reference to the drawing figures referenced below, wherein like structure in different embodiments of the invention is referred to by like numerals throughout the several views.

While the above-identified drawings set forth preferred embodiments of the present invention, other embodiments of the present invention are also contemplated, as noted in the discussion. This disclosure presents illustrative embodiments of the present invention by the way of representation and not limitation. Numerous other modifications and embodiments can be devised by those skilled in the art which fall within scope and spirit of the principles of this invention.

DETAILED DESCRIPTION

Figure 1:
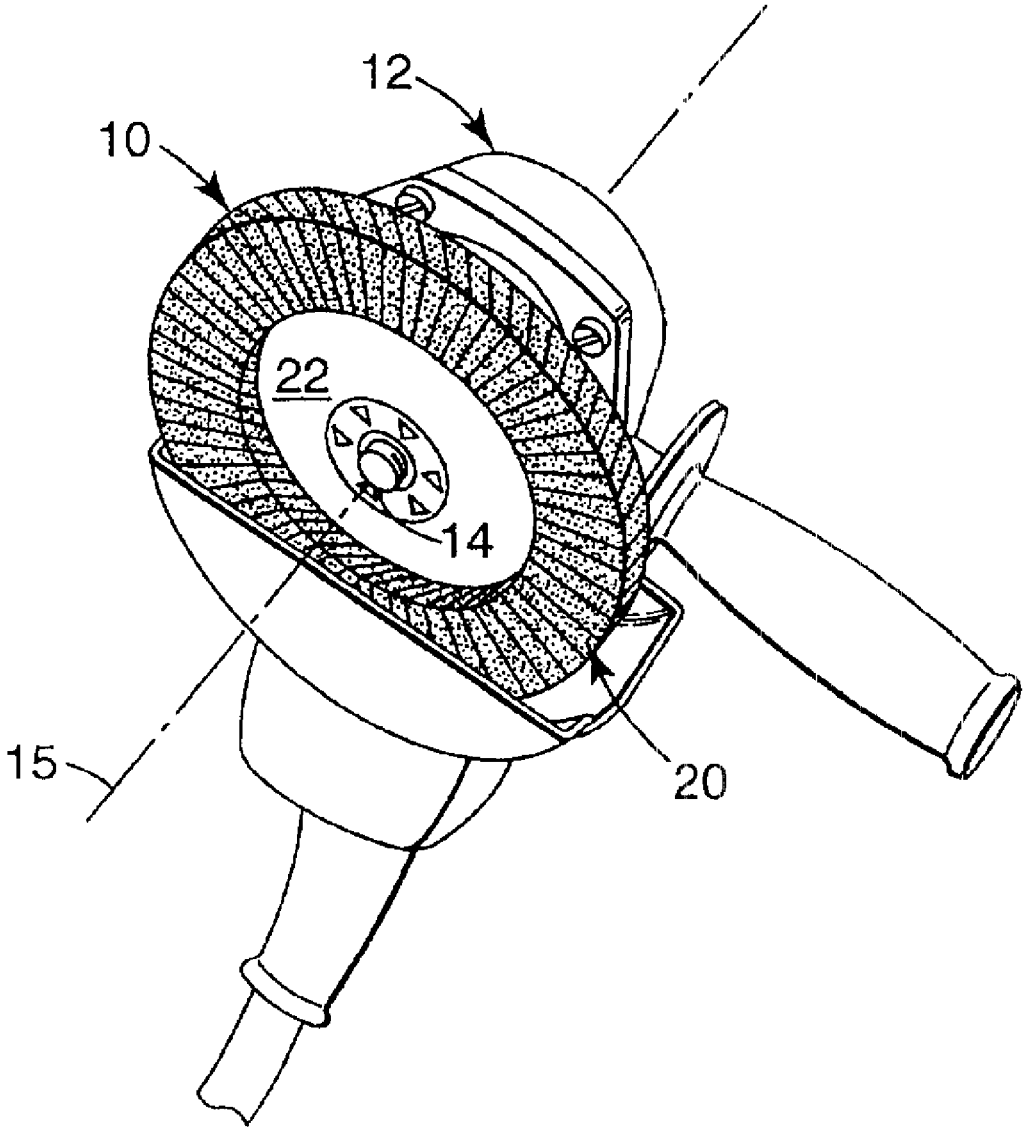
FIG. 1 is a perspective view of an exemplary abrasive article according to the present invention 10 mounted to a tool.

A perspective view of an exemplary abrasive disc according to the present invention is shown in FIG. 1. Abrasive disc 10 is shown mounted to tool (as shown, an angle grinder) 12. Abrasive disc 10 is threaded onto threaded shaft 14 of tool 12. Shaft 14 defines a longitudinal axis 15 extending through the center of abrasive disc 10. Abrasive disc 10 has an annular ring of abrasive material 20 (flap disc as shown) fixably mounted to generally circular backing plate 22. Although abrasive disc 10 is shown mounted to angle grinder 12, it would be understood that any tool having a rotational shaft could be used in conjunction with abrasive disc 10 (e.g., a drill). By "generally circular" it is meant that the abrasive disc is round in shape, and is typically circular, however other shapes (e.g., hexagonal) can be used without departing from the spirit and scope of the invention.

Figure 2:
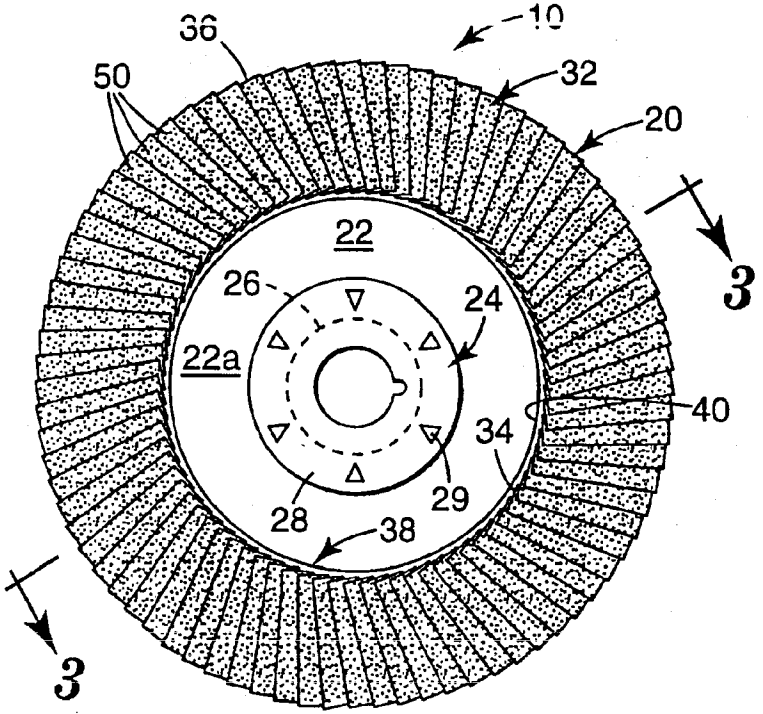
FIG. 2 is a plan view of the exemplary abrasive article according to the present invention as shown in FIG. 1.

FIG. 2 shows a plan view of abrasive disc 10 according to the present invention. Fastener 24 is mounted to backing plate 22 so as to allow threading of abrasive disc 10 to shaft 14 of tool 12. Backing plate 22 has grinding surface 22A and tool surface 22B (shown in FIG. 3). Fastener 24 can be, for example, a "threadless fastener" or sheet metal nut as is known in the art, as well as a Tinnerman nut fastening device, as described, for example, in U.S. Pat. No. 2,156,002 (Tinnerman), the disclosure of which is incorporated herein by reference. While the Tinnerman nut is the preferred fastening device, other types of fasteners may be used without departing from the spirit and scope of the invention. Preferred fastener 24 is a 1.5 inch (38.1 mm) quick-change button for mating with a ⅝ inch diameter by 11 thread per inch shaft (15.875 mm diameter by 0.43 threads per mm), manufactured by Metal Products Engineering, Los Angeles, C&A. Fastener 24 can be formed, for example, from 28 gauge steel, although other materials (e.g., brass or aluminum) may be used without departing from the spirit and scope of the invention. Central aperture 26 (shown in dotted lines in FIG. 2) extends through the center of backing plate 22. Fastening apertures 29 are disposed coaxially about central aperture 26, are radially spaced about central aperture 26, and extend through fastener 24.

Figure 3:
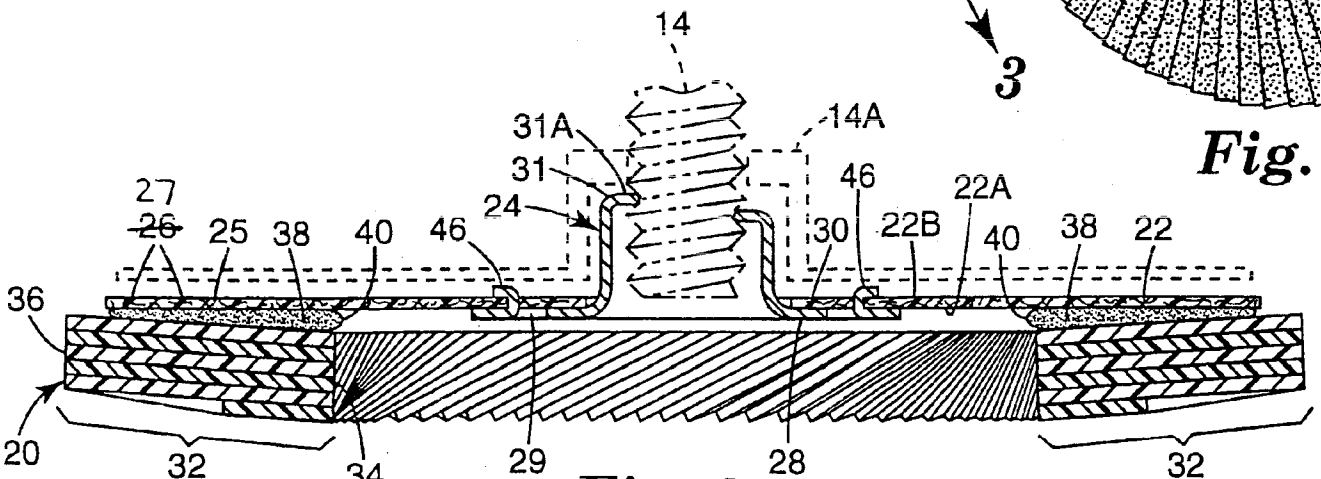
FIG. 3 is a cross-sectional view of the abrasive article shown in FIG. 2, as taken along lines 3—3.

A cross section of abrasive disc 10 shown in FIG. 2 is shown in FIG. 3. Tool shaft 14 (in the dotted lines) is shown threaded into fastener 24 for illustrative purposes. The fastener includes annular flange 28 which is positioned so that top surface 30 of flange 28 engages grinding surface 22A of backing plate 22. Longitudinal engaging cylinder 31, integral with annular flange 28 extends through central aperture 26. Typically, back up pad assembly 14A (shown in dotted lines) is used to support abrasive disc 10 when it is mounted on shaft 14. Shaft 14 of the tool is threaded onto annular ring 31A on cylinder 31. Annular ring 31A allows abrasive disc 10 to be quickly threaded on and off shaft 14.

Abrasive material 20 is adhered to grinding surface 22A of backing plate 22. Abrasive material 20 can be shaped, for example, to form annulus 32 concentric with central aperture 26. Annulus 32 has radially inner edge 34 and radially outer edge 36. Adhesive 38 is disposed between abrasive material 20 and backing plate 22 to fix annulus 32 of abrasive material 20 to backing plate 22. Inner bead 40 of adhesive 38 is disposed along the inner edge 34 of the annulus 32, where the inner edge 34 is most proximate to backing 22.

Fastener 24 is fixed to backing plate 22 by tines 46 which are integral with annular flange 28. Tines 46 are bent through fastening apertures 29, extending from grinding side 22A of backing plate 22 to tool surface 22B of backing plate 22. That portion of each tine 46 which extends beyond tool surface 22B is then bent inwardly (or outwardly) so as to extend radially along tool surface 22B of backing plate 22. Thus, tines 46 engage backing plate 22 so that fastener 24 is fixed, both rotationally and axially, to backing plate 22. Fastening apertures 29 in backing plate 22 are typically formed when fastener 24 is mounted to backing plate 22, as discussed below. Thus, fastener 24 should be formed from a material which is hard enough to push tines 46 through backing plate 22 while being flexible enough so that tines 46 can be bent along tool surface 22B.

Mounting fastener 24 to backing plate 22 using tines 46 to secure fastener 24 in place allows the method of assembly of abrasive disc utilizing the present invention to be simplified. Abrasive disc 10 can be manufactured, for example, by selecting backing plate 22 either manually or automatically (using a machine) and placing backing plate 22 on a rotating spindle. The spindle can be rotated at a constant speed to facilitate the application of the adhesive. The adhesive can be applied, for example, manually or automatically. The amount of adhesive applied can be controlled, for example, by the speed of rotation, time of application, adhesive flow rate, and number of rows to be added to plastic backing plate 22. Such factors can be influenced, for example, by the diameter of the backing plate and the type of abrasive material being adhered to the backing plate. Plastic backing plate 22 can then be indexed to another station, for example, manually or automatically, where, for example, depending on the type of abrasive disc to be formed, rectangular flaps of abrasive are added to the backing plate to form a flap disc, an abrasive ring of material is placed on the backing plate, or abrasive material is otherwise added to the backing plate. The abrasive material can be centered, or otherwise positioned, on the backing plate using, for example, a jig or press. Typically, the adhesive is a curable material which is cured prior to, or after, fastener 24 is added, for example, manually or automatically through central aperture 26 of backing plate 22.

The backing plate 22 is placed in a riveting jig to orient central aperture 26. Fastener 24 is placed in central aperture 26 and oriented to be substantially concentric with the circumference defined by aperture 26. Pressure is applied to a riveting fixture (not shown) that functions to hold backing plate 22 and fastener 24 in place while pushing tines 46 through backing plate 22, and to fold over tines 46 to effect a positive attachment between the backing plate 22 and fastener 24.

The above described method is an exemplary method for fitting a fastener into the backing plate. It is understood that other methods are known in the art and may also be used without departing from the spirit and scope of the invention. For example, the fastener can be extended through the central aperture from the tool surface to the grinding surface. Additionally, for example, a Grit-Lock type fastener, as described for example, in U.S. Pat. No. 4,245,438, (van Buren, Jr.), the disclosure of which is incorporated herein by reference, can be mounted to the backing plate in substantially the same fashion as described above. Additionally, the order of assembly steps need not occur exactly as described above (e.g., fastener 24 can be secured to backing plate 22 before affixing the abrasive material).

Press fitting the fastener into the backing plate allows a quick change fastener to be economically inserted into the abrasive disc. The fastener is lightweight, concentric and rotationally fixed with respect to the disc so that the entire disc can be rotated to thread and unthread the fastener from the shaft, rather than by using wrenches, as was previously required. The result is a significant improvement in user convenience, allowing quick change of abrasive discs, which is desirable when each disc becomes worn or when a disc having different abrasive media is needed. Previous backing plates were made of relatively stiff, inflexible materials that could withstand the harsh grinding environment, however, attempts to press fit fasteners into these previous backing plates resulted in cracking the backing plates.

Although FIGS. 1–4 are representative of abrasive articles according to the present invention, other constructions having other shapes and forms are contemplated without departing from the spirit and scope of the invention. Abrasive articles (e.g., a disc) according to the present invention can possess a wide variety of backing plate shapes depending upon the end uses of the abrasive article. For example, the backing plate can be tapered so that the center portion of backing plate is thicker than the outer portions. The backing plate can have a uniform or non-uniform thickness. The backing plate can be embossed. The center of the backing plate can be depressed, or lower, than the outer portions. The edges of backing plate can be purposely bent to make a "cupped" disc if so desired. The edges of backing plate can also be smooth or scalloped.

The backing plate is sufficiently tough and heat resistant under severe grinding conditions such that the backing plate does not significantly disintegrate or deform from the heat generated during use (e.g., during a grinding, sanding, or polishing operation). One embodiment of a backing plate can operably withstand a temperature at the abrading interface of a workpiece of at least about 200° C. The phrase "at the abrading interface" in the context of temperature and pressure refers to the instantaneous or localized temperature and pressure the backing plate experiences at the contact point between the abrasive material on the article and the workpiece. Thus, the equilibrium or overall temperature of the backing plate can typically be less than the instantaneous or localized temperature at a contact point between the abrasive material and the workpiece during operation.

The backing plate is sufficiently tough such that it will not significantly crack or shatter from the forces encountered during manufacturing of the abrasive article as well as during use. That is, the backing plate is preferably able to operably withstand press fit insertion of the fastener as well as use in a grinding operation conducted with a pressure at the abrading interface of a workpiece of at least about 7 $kg/cm^2$, preferably at least about 13.4 $kg/cm^2$. Embodiments of the present invention utilize a backing plate that exhibits sufficient flexibility to withstand typical grinding conditions, and preferably severe grinding conditions. By "sufficient flexibility" it is meant that the backing plate can be bent and returned to its original shape without significant permanent deformation. That is, for some grinding operations, a "flexible" backing plate is one that is capable of flexing and adapting to the contour of the workpiece being abraded without permanent deformation of backing plate, yet is sufficiently strong to transmit an effective grinding force when pressed against the workpiece.

Embodiments of the present invention utilize a backing plate that possesses a flexural modulus of at least about 9000 $kg/cm^2$ under ambient conditions, with a sample size of 25.4 mm (width)×50.8 mm (span across the jig)×0.8–1.0 mm (thickness), and a rate of displacement of 4.8 mm/min, as determined by following the procedure outlined in the American Society for Testing and Materials (ASTM) D790 (published 1991) test method, the disclosure of which is incorporated herein by reference. Some embodiments of the backing plate possess a flexural modulus of between about 9000 $kg/cm^2$ and about 141,000 $kg/cm^2$. Flexural moduli less than about 9000 $kg/cm^2$ are typically too low to provide the desired level of abrading performance. A backing plate with a flexural modulus greater than about 141,000 $kg/cm^2$ is generally too stiff to sufficiently conform to the surface of the workpiece.

Briefly, the ASTM D790 test method involves the use of either a three-point loading system utilizing center loading by means of a loading nose, which has a cylindrical surface, midway between two supports, each of which have a cylindrical surface; or a four-point loading system utilizing two load points equally spaced from their adjacent support points, with a distance between load points of either one-third or one-half of the support span. The specimen is deflected until rupture occurs or until the maximum strain has reached 0.05 mm/mm (i.e., a 5% deflection). The flexural modulus (i.e., tangent modulus of elasticity) is determined by the initial slope of the load vs. deflection curve.

Embodiments of the present invention utilize a backing plate that exhibit sufficient flexural toughness. By "sufficient flexural toughness" it is meant that backing plate is sufficiently stiff to withstand insertion of the fastener during assembly of the abrasive article as well as grinding conditions, but not undesirably brittle such that cracks are formed in the backing plate, thereby decreasing its structural integrity.

The desirable toughness of backing plate can also be demonstrated by measuring the impact strength of the backing plate. The impact strength can be measured by following the test procedures outlined in ASTM D256 (published 1990, version b) or D3029 (published 1990) test methods, the disclosures of which are incorporated herein by reference. These methods involve a determination of the force required to break a standard test specimen of a specified size. The backing plate preferably has an impact strength (i.e., a Gardner Impact value) or mean failure energy of at least about 0.4 Joules for a 0.89 mm thick sample under ambient conditions. More preferably, a backing plate utilized in the present invention has a Gardner Impact value of at least about 0.9 Joules for a 0.89 mm thick sample under ambient conditions, and most preferably at least about 1.6 Joules for a 0.89 mm thick sample under ambient conditions.

Embodiments of the present invention utilize a backing plate having desirable tensile strength. Tensile strength is a measure of the greatest longitudinal stress a substance can withstand without tearing apart. It demonstrates the resistance to rotational failure and "snagging" as a result of high resistance at discontinuities in the workpiece that the abrasive article might contact during operation. A desirable tensile strength is defined as at least about 17.9 kg/cm of width at about 150° C. for a sample thickness of about 0.75–1.0 mm.

Embodiments of the present invention utilize a backing plate that exhibits appropriate shape control and are sufficiently insensitive to environmental conditions, such as humidity and temperature. By this it is meant that preferred backing plates possess the above-listed properties under a wide range of environmental conditions. Preferably, the backing plate possess the above-listed properties within a temperature range of about 10–30° C., and a humidity range of about 30–50% relative humidity (RH). More preferably, the backing plate possess the above-listed properties under a wide range of temperatures (i.e., from below 0° C. to above 100° C.) and a wide range of humidity values (i.e., from below 10% RH to above 90% RH).

Under extreme conditions of humidity (i.e., conditions of high humidity, greater than about 90% RH, and low humidity, less than about 10% RH), the backing plate is not significantly affected by either expansion or shrinkage due, respectively, to water absorption or loss. As a result, abrasive articles utilized in the present invention will not significantly deform (e.g., cup or curl in either a concave or a convex fashion).

The backing plate contains a thermoplastic binder material (25 as shown in FIG. 3) and an effective amount of a fibrous reinforcing material (27 as shown in FIG. 3). By an "effective amount" of a fibrous reinforcing material, it is meant that the backing plate contains a sufficient amount of the fibrous reinforcing material to impart at least improvement in heat resistance, toughness, flexibility, stiffness, shape control, etc., discussed above.

Preferably, the amount of the thermoplastic binder material in the backing plate is within a range of about 60–99%, more preferably within a range of about 62–95%, and most preferably within a range of about 65–85%, based upon the total weight of the backing plate. The remainder of a typical, backing plate is primarily the fibrous reinforcing material with few, if any, voids throughout the hardened backing plate composition. Although there can be additional components added to the binder composition, the backing plate utilized in the present invention primarily contains a thermoplastic binder material and an effective amount of a fibrous reinforcing material.

Typically, the higher the content of the reinforcing material, the stronger backing plate is. If there is too much fibrous reinforcing material, however, the backing plate may be too brittle for desired applications. By proper choice of thermoplastic binder material and fibrous reinforcing material, such as, for example, a polyamide thermoplastic binder and glass reinforcing fiber, considerably higher levels of the binder can be employed to produce a hardened backing plate composition with few if any voids and with the properties as described above.

Optionally, the hardened material forming the backing plate possesses a void volume of less than about 0.1%. Herein "void volume" means a volume within the backing plate filled with air or gas (i.e., absent solid material). The percent void volume can be determined by comparing the actual density (mass/volume) of the hardened backing plate composition to the total calculated density of the various components. That is, the percent void volume equals [1-(actual density/calculated density)]×100.

A thermoplastic binder material is a polymeric material (e.g., an organic polymeric material) that softens and melts when exposed to elevated temperatures and generally returns to its original condition (i.e., its original physical state) when cooled to ambient temperatures. During the manufacturing process, the thermoplastic binder material is heated above its softening temperature, or in some instances above its melting temperature, to cause it to flow and form the desired shape of the abrasive article. After the backing plate is formed, the thermoplastic binder is cooled and solidified. In this way the thermoplastic binder material can be molded into various shapes and sizes.

The backing plate can be formed, for example, by shaping or molding the thermoplastic material using conventional molding techniques such as injection molding. Use of such molding techniques can reduce the amount of materials wasted in construction, relative to conventional "web" processes. Injection molding can also allow for the backing plate to be more concentric than what was previously available. Making the backing plate concentric aids in minimizing or eliminating wobbling during use of the abrasive disc. Additionally, for example, a concentric backing plate may allow tighter manufacturing tolerances to be kept (i.e., when mounting the abrasive material and the fastener). Additionally, for example, higher concentricity of the abrasive disc can minimize or prevent curling of the edges which can occur during grinding, thereby increasing the efficiency of the abrasive disc.

Molding technologies can also allow for controlling shrinkage of the backing plate during manufacturing, and allow for molding structural members (e.g., ridges) into the backing plate, (as is known in the art), to help minimize or prevent warpage.

Web manufacturing processes can also be used to form the backing plate. In a typical web manufacturing process, the backing plate for the abrasive disc is made in a continuous web form and then cut into the desired disc shape. Although injection molding techniques can be used to produce backing plates for the backing plates utilized in the present invention (to provide tighter manufacturing tolerances as well as avoid waste) this is not intended to mean that conventional "web" processes cannot be used. On the contrary, using conventional web processes to form the backing plate may be necessary when using certain embodiments of the backing plate (e.g., thermoplastic impregnated cloths).

Moldable thermoplastic materials utilized in the present invention include those having a high melting temperature, good heat resistance properties, and good toughness properties such that the hardened backing plate composition containing these materials operably withstands abrading conditions and mechanical insertion of the fastener without substantially deforming or disintegrating.

Hardened backing plate compositions include those that can withstand a temperature of at least about 200° C. and a pressure of at least about 7 kg/cm$^2$, preferably at least about 13.4 kg/cm$^2$, at the abrading interface of a workpiece. Moldable thermoplastic materials include those having a melting point of at least about 200° C., preferably at least about 220° C. Additionally, the melting temperature of the tough, heat resistant, thermoplastic material is preferably sufficiently lower (i.e., at least about 25° C. lower) than the melting temperature of the fibrous reinforcing material. In this way, the fibrous reinforcing material is not adversely affected during the molding of the binder. Suitable thermoplastic materials also include those that are generally insoluble in an aqueous environment, at least because of the desire to use the abrasive disc on wet surfaces.

Examples of thermoplastic materials suitable for preparations of backing plates in abrasive articles according to the present invention include polycarbonates, polyetherimides, polyesters, polysulfones, polystyrenes, acrylonitrile-butadiene-styrene block copolymers, acetal polymers, polyamides, and combinations thereof. Polyamide materials are preferred thermoplastic binder materials, at least because they are inherently tough and heat resistant, typically provide good adhesion to the preferred adhesive resins without priming, and are relatively inexpensive.

A preferred thermoplastic material from which the backing plate is formed is a polyamide resin material, which is characterized by having an amide group, i.e., —C(O)NH—. Various types of polyamide resin materials (i.e., nylons) can be used, such as nylon 6/6 or nylon 6. Nylon 6/6 is a condensation product of adipic acid and hexamethylenediamine. Nylon 6/6 has a melting point of about 264° C. and a tensile strength of about 770 kg/cm$^2$. Nylon 6 is a polymer of $\epsilon$-caprolactam. Nylon 6 has a melting point of about 223° C. and a tensile strength of about 700 kg/cm$^2$.

Examples of commercially available nylon resins useable as backing plates in articles according to the present invention include those available under the trade designations "VYDYNE" from Monsanto, St. Louis, Mo.; "ZYTEL" and "MINLON" both from DuPont, Wilmington, Del.; "TROGAMID T" from Huls America, Inc., Piscataway, N.J.; "CAPRON" from Allied Chemical Corp., Morristown, N.J.; "NYDUR" from Mobay, Inc., Pittsburgh, Pa.; and "ULTRAMID" from BASF Corp., Parsippany, N.J. Although a mineral-filled thermoplastic material can be used, such as the mineral-filled nylon 6 resin available under the trade designation "MINLON.".

Once again, besides the thermoplastic binder material, backing plates utilized in the present invention include an effective amount of fibrous reinforcing material. As discussed, an "effective amount" of a fibrous reinforcing material is a sufficient amount to impart at least improvement in the physical characteristics of the backing plate (i.e., heat resistance, toughness, flexibility, stiffness, shape control, etc.). Additionally, not so much fibrous reinforcing material is used as to give rise to any significant number of voids and detrimentally affect the structural integrity of the backing plate. Preferably, the amount of the fibrous reinforcing material in the backing plate is within a range of about 1–45%, more preferably within a range of about 5–40%, and most preferably within a range of about 15–35%, based upon the weight of the backing plate.

The fibrous reinforcing material can be in the form of individual fibers or fibrous strands, or in the form of a fiber mat or web. The fibrous reinforcing material can be, for example, in the form of individual fibers or fibrous strands for advantageous manufacture. Fibers are typically defined as fine thread-like pieces with an aspect ratio of at least about 100:1. The aspect ratio of a fiber is the ratio of the longer dimension of the fiber to the shorter dimension. The mat or web can be either in a woven or nonwoven matrix form. A nonwoven mat is a matrix of a random distribution of fibers made by bonding or entangling fibers by mechanical, thermal, or chemical means.

Examples of useful reinforcing fibers in applications of the present invention include metallic fibers or nonmetallic fibers. The nonmetallic fibers include glass fibers, carbon fibers, mineral fibers, synthetic or natural fibers formed of heat resistant organic materials, or fibers made from ceramic materials. Preferred fibers for applications of the present invention include nonmetallic fibers, and more preferred fibers include heat resistant organic fibers, glass fibers, or ceramic fibers.

"Heat resistant" organic fibers, refer to organic fibers that are resistant to melting, or otherwise breaking down, under the conditions of manufacture and use of the backing plates. Examples of useful natural organic fibers include wool, silk, cotton, or cellulose. Examples of useful synthetic organic fibers include polyvinyl alcohol fibers, polyester fibers, rayon fibers, polyamide fibers, acrylic fibers, aramid fibers, or phenolic fibers. The preferred organic fiber for applications of the present invention is aramid fiber. Such fiber is commercially available from the DuPont Co., Wilmington, Del. under the trade designations of "KEVLAR" and "NOMEX."

Generally, any ceramic fiber is useful in applications of the present invention. Examples of ceramic fibers suitable for the present invention include those marketed under trademark designations "NEXTEL 312,440,610,650 and 720" by the 3M Company, St. Paul, Minn.

The most preferred reinforcing fibers for applications of the present invention are glass fibers, at least because they impart desirable characteristics to the coated abrasive articles and are relatively inexpensive. Furthermore, suitable interfacial binding agents exist to enhance adhesion of glass fibers to thermoplastic materials. Glass fibers are typically classified using a letter grade. For example, E glass (for electrical) and S glass (for strength). Letter codes also designate diameter ranges, for example, size "D" represents a filament of diameter of about 6 micrometers and size "G" represents a filament of diameter of about 10 micrometers. Useful grades of glass fibers include both E glass and S glass of filament designations D through U. Preferred grades of glass fibers include E glass of filament designation "G" and S glass of filament designation "G."Commercially available glass fibers are available, for example, from Specialty Glass Inc., Oldsmar, Fla.; Owens-Corning Fiberglass Corp., Toledo, Ohio; and Mo-Sci Corporation, Rolla, Mo.

If glass fibers are used, it is preferred that the glass fibers are accompanied by an interfacial binding agent (i.e., a coupling agent, such as a silane coupling agent) to improve the adhesion to the thermoplastic material. Examples of silane coupling agents include those marketed under the trade designations "Z-6020" and "Z-6040," by Dow Corning Corp., Midland, Mich.

Advantages can be obtained through use of fiber materials of a length as short as 100 micrometers, or as long as needed for one continuous fiber. Preferably, the length of the fiber is from about 0.5 mm to about 50 mm, more preferably from about 1 mm to about 25 mm, and most preferably from about 1.5 mm to about 10 mm. The fibrous reinforcing material denier, i.e., degree of fineness, for preferred fibers ranges from about 1 to about 5000 denier, typically between about 1 and about 1000 denier. More preferably, the fiber denier will be between about 5 and about 300, and most preferably between about 5 and about 200. It is understood that the denier is strongly influenced by the particular type of fibrous reinforcing material employed.

The fibrous reinforcing material can be distributed throughout the thermoplastic material (i.e., throughout the body of the backing plate, rather than merely embedded in the surface of the thermoplastic material). This is for the purpose of imparting improved strength and wear characteristics throughout the body of the backing plate. A construction wherein the fibrous reinforcing material is distributed throughout the thermoplastic binder material of the backing plate body can be made using either individual fibers or strands, or a fibrous mat or web structure of dimensions substantially equivalent to the dimensions of the finished backing plate. Although in this preferred embodiment distinct regions of the backing plate may not have fibrous reinforcing material therein, it is preferred that the fibrous reinforcing material be distributed substantially uniformly throughout the backing plate.

The fibrous reinforcing material can be oriented as desired for advantageous applications of the present invention. That is, the fibers can be randomly distributed, or they can be oriented to extend along a direction desired for imparting improved strength and wear characteristics. Typically, if orientation is desired, the fibers should generally extend transverse (±20°) to the direction across which a tear is to be avoided.

The backing plates can further include an effective amount of a toughening agent. This will be preferred for certain applications. A primary purpose of the toughening agent is to increase the impact strength of backing plate. By "an effective amount of a toughening agent" it is meant that the toughening agent is present in an amount to impart at least improvement in backing plate toughness without it becoming too flexible. Backing plates utilized in the present invention preferably include sufficient toughening agent to achieve the desirable impact test values listed above.

Embodiments of the present invention can utilize a backing plate comprising between about 1% and about 30% of the toughening agent, based upon the total weight of the backing plate. Preferably, the toughening agent (i.e., toughener) is present in an amount of about 5–15 wt- %. The amount of toughener present in a backing plate may vary depending upon the particular toughener employed. For example, the fewer elastomeric characteristics a toughening agent possesses, the larger the quantity of toughening agent may be required to impart desirable properties to the backing plates.

Examples of toughening agents that impart desirable stiffness characteristics to backing plate of the present invention include rubber-type polymers (e, natural rubber and synthetic elastomers) and plasticizers.

Examples of toughening agents (i.e., rubber tougheners and plasticizers) include: toluenesulfonamide derivatives (such as a mixture of N-butyl- and N-ethyl-p-toluenesulfonamide, commercially available, for example, from Akzo Chemicals, Chicago, Ill., under the trade designation "KETJENFLEX 8"); styrene butadiene copolymers; polyether backbone polyamides (commercially available, for example, from Atochem, Glen Rock, N.J., under the trade designation "PEBAX"); rubber-polyamide copolymers (commercially available, for example, from DuPont, Wilmington, Del., under the trade designation "ZYTEL FN"); and functionalized triblock polymers of styrene-(ethylene butylene)-styrene (commercially available, for example, from Shell Chemical Co., Houston, Tex., under the trade designation "KRATON FGI901"); and mixtures thereof. Of this group, rubber-polyamide copolymers and styrene-(ethylene butylene)-styrene triblock polymers are more preferred, at least because of the beneficial characteristics they impart to backing plates and the manufacturing process of the present invention. Rubber-polyamide copolymers are the most preferred, at least because of the beneficial impact and grinding characteristics they impart to backing plates utilized in the present invention.

If the backing plate is made by injection molding, typically the toughener is added as a dry blend of toughener pellets with the other components. The process usually involves tumble-blending pellets of toughener with pellets of fiber-containing thermoplastic material. A more preferred method involves compounding the thermoplastic material, reinforcing fibers, and toughener together in a suitable extruder, pelletizing this blend, then feeding these prepared pellets into the injection molding machine. Commercial compositions of toughener and thermoplastic material are available, for example, under the designation "ULTRAMID" from BASF Corp., Parsippany, N.J. Specifically, "ULTRAMID B3ZG6" is a nylon resin containing a toughening agent and glass fibers that is useful in the present invention.

Besides the materials described above, the backing plate utilized in the present invention can include effective amounts of other materials or components depending upon the end properties desired. For example, the backing plate can include a shape stabilizer (i.e., a thermoplastic polymer with a melting point higher than that described above for the thermoplastic binder material). Suitable shape stabilizers include, but are not limited to, poly(phenylene sulfide), polyimides, and polyaramids. An example of a preferred shape stabilizer is polyphenylene oxide nylon blend commercially available, for example, from General Electric, Pittsfield, Mass., under the trade designation "NORYL GTX 910." If a phenolic-based make coat and size coat are employed in the coated abrasive construction, however, the polyphenylene oxide nylon blend is not preferred because of nonuniform interaction between the phenolic resin adhesive layers and the nylon, resulting in reversal of the shape-stabilizing effect. This nonuniform interaction results from a difficulty in obtaining uniform blends of the polyphenylene oxide and the nylon.

Other such optional materials that can be added to the backing plate for certain applications of the present invention include inorganic or organic fillers. Inorganic fillers are also known as mineral fillers. A filler is defined as a particulate material, typically having a particle size less than about 100 micrometers, preferably less than about 50 micrometers. Examples of useful fillers for applications of the present invention include carbon black, calcium carbonate, silica, calcium metasilicate, cryolite, phenolic fillers, or polyvinyl alcohol fillers. If a filler is used, it is theorized that the filler fills in between the reinforcing fibers and may prevent crack propagation through the backing plate. Typically, a filler would not be used in an amount greater than about 20%, based on the weight of the backing plate. Preferably, at least an effective amount of filler is used. Herein, the term "effective amount" in this context refers to an amount sufficient to fill but not significantly reduce the tensile strength of the hardened backing plate.

Other useful optional materials or components that can be added to the backing plate for certain applications of the present invention include pigments, oils, anti-static agents, flame retardants, heat stabilizers, ultraviolet stabilizers, internal lubricants, antioxidants, and processing aids. One would not typically use more of these components than needed for desired results.

Other examples of suitable materials for the backing plate are described in U.S. Pat. No. 5,316,812, (Stout et al.) and U.S. Pat. No. 5,669,941 (Peterson), the disclosures of which are incorporated by herein by reference.

Utilizing the binder in combination with the fibrous reinforcing material provides strength and flexibility to the backing plate material which allows it to be thinner and lighter than backing plates used in previous abrasive discs (e.g., thermoplastic impregnated cloth). The mechanical properties of the backing plate in the inventive abrasive disc allow the fastener to be press fitted into the backing plate without cracking the backing plate while the backing plate remains strong enough to withstand the harsh grinding environment.

Preferably, the backing plate is between 3 inches (7.62 cm) to 7 inches (17.78 cm) in diameter and is substantially circular in shape, since these are standard industry sizes for abrasive discs. However, a person skilled in the art would realize that other sizes may be contemplated without departing from the spirit and scope of the invention. The backing plate is typically formed to a thickness of from approximately 20 mils (0.51 mm) to approximately 70 mils (1.78 mm), more preferably from approximately 40 mils (1.02 mm) to approximately 55 mils (1.40 mm), and most preferably to approximately 50 mils (1.27 mm).

Thin backing plates have additional advantages. For example, making an abrasive disc with a thin, strong backing plate decreases the weight of the abrasive disc. Higher RPM's are required in many industrial grinding applications. With a lighter abrasive disc, the force required to spin the abrasive disc is reduced. Thus, the revolutions per minute (RPM's) which can be generated by the same amount of force is increased. Additionally, decreasing the weight of the abrasive disc will reduce the weight borne by the operator, reducing worker fatigue. Finally, thinner backing plates require less material to produce, and are inherently cheaper.

Backing plates utilized in the present invention can allow the use of lightweight threadless fasteners that can be punched into the backing plate. Molding structural members into the backing plate increases the structured strength of the backing plate without substantially increasing the weight of the backing plate. All these features allow decreased overall weight of the tool, decreasing worker fatigue.

Abrasive material used in abrasive articles according to the present can be shaped to form an annulus of material mounted on the backing plate. In one embodiment of the inventive abrasive disc, abrasive material is coated onto individual flaps (50 shown in FIG. 2) which are overlapped and adhered to the backing plate, forming a "flap disc" as is known in the art and illustrated in FIG's 1–3. The flaps are arranged such that when the abrasive disc is attached to the tool (12 as shown in FIG. 1) and brought into contact with a work surface the rotation of the abrasive disc causes the abrasive flaps to abrade the work surface.

Other embodiments of abrasive articles according to the present invention can use different abrasive material such as coated abrasives, bonded abrasives and non-woven abrasives, all of which are known in the art.

Figure 4:
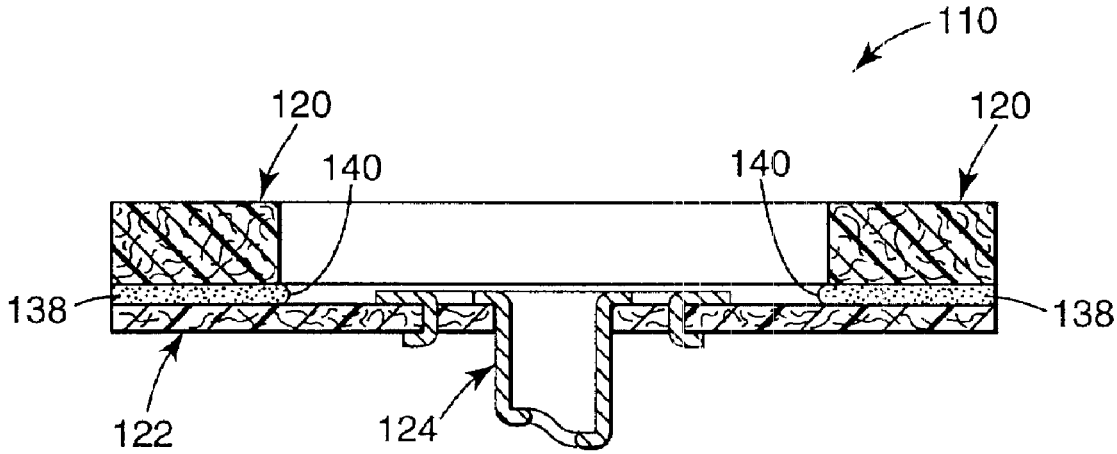
FIG. 4 is a cross-sectional view of an additional exemplary abrasive article according to the present invention.

Another example of an exemplary abrasive disc according to the present invention is shown in FIG. 4. Abrasive disc, 110 includes abrasive material 122, fastener 124, and adhesive 138 (including inner bead 140 of adhesive 138) as described with respect to FIGS. 1–3. Abrasive article 120 in FIG. 4 is illustrated as a nonwoven abrasive. Nonwoven abrasive products (illustrated, for example, in FIG. 4) typically include an open porous lofty polymer filament structure having abrasive grains distributed throughout the structure and adherently bonded therein by an organic binder. Examples of filaments include polyester fibers, polyamide fibers, and polyaramid fibers.

Techniques for making abrasive layers, materials, etc., are known in the art, as are materials for making the same (see, e.g., U.S. Pat. No. 4,314,827 (Leitheiser et al.); U.S. Pat. No. 4,518,397 (Leitheiser et al.); U.S. Pat. No. 4,623,364 (Cottringer el al.); U.S. Pat. No. 4,744,802 (Schwabel); U.S. Pat. No. 4,770,671 (Monroe et al.); U.S. Pat. No. 4,881,951 (Wood et al.); U.S. Pat. 5,011,508 (Wald et al.); U.S. Pat. No. 5,139,978 (Wood); U.S. Pat. No. 5,201,916 (Berg et al.); U.S. Pat. No. 5,366,523 (Rowenhorst et al.); U.S. Pat. No. 5,429,647 (Larmie); U.S. Pat. No. 5,498,269 (Larmie); U.S. Pat. No. 5,551,963 (Larmie); U.S. Pat. No. 4,311,489 (Kressner); U.S. Pat. No. 4,652,275 (Bloecher et al.); U.S. Pat. No. 4,799,939 (Bloecher et al.); U.S. Pat. No. 4,734,104 (Broberg); U.S. Pat. 4,737,163 (Larkey); U.S. Pat. No. 5,203,884 (Stout et al.); U.S. Pat. No. 5,496,386 (Broberg et al.); U.S. Pat. No. 5,609,706 (Benedict et al.); U.S. Pat. No. 5,961,674 (Gagliardi et al.); U.S. Pat. No. 4,543,107 (Rue); and U.S. Pat. No. 2,958,593 (Hoover et al.), the disclosures of which are incorporated herein by reference).

Suitable organic binders for making abrasive layers include thermosetting organic polymers. Examples of suitable thermosetting organic polymers include phenolic resins, urea-formaldehyde resins, melamine-formaldehyde resins, urethane resins, acrylate resins, polyester resins, aminoplast resins having pendant $\alpha,\beta$-unsaturated carbonyl groups, epoxy resins, acrylated urethane, acrylated epoxies, and combinations thereof. The binder and/or abrasive product may also include additives such as fibers, lubricants, wetting agents, thixotropic materials, surfactants, pigments, dyes, antistatic agents (e.g., carbon black, vanadium oxide, graphite, etc.), coupling agents (e.g., silanes, titantates, zircoaluminates, etc.), plasticizers, suspending agents, and the like. The amounts of these optional additives are selected to provide the desired properties. The coupling agents can improve adhesion to the abrasive particles and/or filler. The binder chemistry may be thermally cured, radiation cured or combinations thereof. Additional details on binder chemistry may be found, for example, in U.S. Pat. No. 4,588,419 (Gaul et al.), U.S. Pat. No. 4,751,137 (Tumey et al.), and U.S. Pat. No. 5,436,063 (Follett et al.), the disclosures of which are incorporated herein by reference.

Typically, the abrasive particles have a moh's hardness of at least 5, 6, 7, 8, 9, or even 10. Suitable abrasive grains include fused aluminum oxide (including white fused alumina, heat-treated aluminum oxide and brown aluminum oxide), silicon carbide, boron carbide, titanium carbide, diamond, cubic boron nitride, garnet, fused alumina-zirconia, and sol-gel-derived abrasive particles, and the like. The sol-gel-derived abrasive particles may be seeded or non-seeded. Likewise, the sol-gel-derived abrasive particles may be randomly shaped or have a shape associated with them, such as a rod or a triangle. Examples of sol gel abrasive particles include those described in U.S. Pat. No. 4,314,827 (Leitheiser et al.), U.S. Pat. No. 4,518,397 (Leitheiser et al.), U.S. Pat. No. 4,623,364 (Cottringer et al.), U.S. Pat. No. 4,744,802 (Schwabel), U.S. Pat. No. 4,770,671 (Monroe et al.), U.S. Pat. No. 4,881,951 (Wood et al.), U.S. Pat. No. 5,011,508 (Wald et al.), U.S. Pat. No. 5,090,968 (Pellow), U.S. Pat. No. 5,139,978 (Wood), U.S. Pat. No. 5,201,916 (Berg et al.), U.S. Pat. No. 5,227,104 (Bauer), U.S. Pat. No. 5,366,523 (Rowenhorst et al.), U.S. Pat. No. 5,429,647 (Larmie), U.S. Pat. No. 5,498,269 (Larmie), and U.S. Pat. No. 5,551,963 (Larmie), the disclosures of which are incorporated herein by reference. The abrasive grains may also be present in the form of abrasive agglomerates.

For the embodiments of the abrasive discs shown in FIGS. 1–4, the abrasive material 20 and 120 is adhered to the backing plate 22 and 122 by adhesive 38 and 138. Radial and axial thickness of the abrasive 20 and 120 may vary according to the desired application and the type of abrasive material.

Abrading with abrasive articles according to the present invention may be done dry or wet. For wet abrading, the liquid may be introduced or supplied in the form of a light mist to complete flood: Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like.

Abrasive articles according to the present invention may be used to abrade workpieces such as aluminum and aluminum alloys, carbon steels, mild steels, tool steels, stainless steel, hardened steel, brass, titanium, glass, ceramics, wood, wood-like materials, plastics, paint, painted surfaces, organic coated surfaces and the like.

Although the present invention has been described with reference to preferred embodiments, workers skilled in the art will recognize that changes may be made in form and detail without departing from the spirit and scope of the invention.

What is claimed is:

1. An abrasive article comprising:

a backing plate having a first major surface and a second major surface opposite the first major surface, wherein the backing plate is generally circular, wherein the backing plate includes a central aperture extending therethrough, wherein the backing plate comprises a thermoplastic binder material and fibrous reinforcing material; and wherein the article is a flap disc, an abrasive layer secured to the first major surface of the backing plate; and a fastener press fitted to the backing plate so as to be concentric with the central aperture, wherein the fastener includes a plurality of penetrating members and further wherein each penetrating member pierces the backing plate from the grinding surface side.

2. An abrasive article comprising:

a backing plate having a first major surface and a second major surface opposite the first major surface, wherein the backing plate is generally circular, wherein the backing plate includes a central aperture extending therethrough, wherein the backing plate comprises a thermoplastic binder material and fibrous reinforcing material;

an abrasive layer secured to the first major surface of the backing plate; and a fastener press fitted to the backing plate so as to be concentric with the central aperture, wherein the fastener includes a plurality of penetrating members and further wherein each penetrating member pierces the backing plate from the grinding surface side, wherein the fastener is shaped to form a Tinnerman nut.

3. An abrasive article comprising:

a backing plate having a first major surface and a second major surface opposite the first major surface, wherein the backing plate is generally circular, wherein the backing plate includes a central aperture extending therethrough, wherein the backing plate comprises a thermoplastic binder material and fibrous reinforcing material;

an abrasive layer secured to the first major surface of the backing plate; and a fastener press fitted to the backing plate so as to be concentric with the central aperture, wherein the fastener includes a plurality of penetrating members and further wherein each penetrating member pierces the backing plate from the grinding surface side, wherein the fastener is shaped to form a Grit-lock nut.

4. A method of making an abrasive article comprising:

applying adhesive to a backing plate having a central aperture, wherein the backing plate comprises a thermoplastic binder material and fibrous reinforcing material;

disposing abrasive material onto the adhesive, wherein the abrasive material is selected from a coated, non-woven, or bonded abrasive;

disposing the backing plate onto a jig;

disposing a fastener having tines so as to be concentric with the central aperture; and pushing the tines through the backing plate and folding the tines so as to fixably attach the fastener to the backing plate.

5. The method of claim 4 wherein the abrasive material further comprises a substrate and a plurality of abrasive particles secured to the substrate by a binder.

6. A method of abrading a surface, said method comprising:

providing an abrasive article comprising:

a backing plate having a first major surface and a second, major surface opposite the first major surface, wherein the backing plate includes a central aperture extending therethrough, and wherein the backing plate comprises a thermoplastic binder material and fibrous reinforcing material;

an abrasive layer secured to the first major surface of the backing plate, wherein the abrasive layer comprises a substrate and a plurality of abrasive particles secured to the substrate by a binder; and a fastener press fitted to the backing plate so as to be concentric with the central aperture, wherein the fastener includes a plurality of penetrating members and further wherein each penetrating member pierces the backing plate from the grinding surface side;

attaching the abrasive article to a shaft through the central aperture of the abrasive article;

contacting at least a portion of the abrasive layer with a surface of a workpiece; and moving the abrasive article relative to the surface of the workpiece such that at least a portion of the workpiece is abraded by at least a portion of the abrasive layer.

7. The method according to claim 6 wherein the backing plate is generally circular.

8. The method of claim 6, further comprising:

providing a back up pad mounted to a tool shaft;

wherein the step of attaching the abrasive article to a shaft includes attaching the abrasive article to the shaft adjacent the back up pad.

9. The method of claim 6, wherein the abrasive layer is made of an abrasive material selected from a coated, non-woven, or bonded abrasive.

10. An abrasive article comprising:

a backing plate having a first major surface and a second major surface opposite the first major surface, wherein the backing plate includes a central aperture extending therethrough, and wherein the backing plate comprises a thermoplastic binder material and fibrous reinforcing material;

an abrasive layer secured to the first major surface of the backing plate, wherein the abrasive layer comprises a substrate and a plurality of abrasive particles secured to the substrate by a binder; and a fastener press fitted to the backing plate so as to be concentric with the central aperture, wherein the fastener includes a plurality of penetrating members and further wherein each penetrating member pierces the backing plate from the grinding surface side.

11. The abrasive article of claim 10, wherein the backing plate is generally circular.

12. The abrasive article of claim 11, wherein the thermoplastic binder material includes polyamide.

13. The abrasive article of claim 11, wherein the thermoplastic binder material includes polyester.

14. The abrasive article of claim 11, wherein the fibrous reinforcing material comprises glass fibers.

15. The abrasive article of claim 11, wherein backing plate is further comprised of glass-filled nylon.

16. The abrasive article of claim 11, wherein the backing plate has a thickness of from about 0.51 mm to about 1.78 mm.

17. The abrasive article of claim 11, wherein the backing plate has a thickness of from about 1.02 mm to about 1.40 mm.

18. The abrasive article of claim 11, wherein the backing plate has a thickness of about 1.27 mm.

19. The abrasive article of claim 11, further comprising adhesive disposed between the abrasive layer and the first major surface of the backing plate.

20. The abrasive article of claim 11, wherein the fastener is a quick-change type.

21. The abrasive article of claim 11, wherein the abrasive layer is made of a non-woven abrasive forming a raised annulus.

* * * * *

UNITED STATES PATENT AND TRADEMARK OFFICE

CERTIFICATE OF CORRECTION

PATENT NO. : 6,863,596 B2
DATED : March 8, 2005
INVENTOR(S) : Fritz, Peter J.

It is certified that error appears in the above-identified patent and that said Letters Patent is hereby corrected as shown below:

Column 14,
Line 62, delete the word "Gaul" and insert in place thereof -- Caul --.

Column 15,
Line 57, after "material" delete ";" and insert in place thereof -- , --.
Line 57, after "disc" delete "," and insert in place thereof -- ; --.
Lines 60-61, delete the words "be concentric with" and insert in place thereof -- define --.
Lines 61-64, after "aperture" delete ", wherein the fastener includes a plurality of penetrating members and further wherein each penetrating member pierces the backing plate from the grinding surface side." and insert in place thereof -- . --.

Column 16,
Line 3, after "therethrough" insert -- and --.
Lines 8-9, delete the words "be concentric with" and insert in place thereof -- define --.
Line 11, after "aperture," delete "wherein the fastener includes a plurality of penetrating members and further wherein each penetrating member pierces the backing plate from the grinding surface side,"
Line 19, after "therethrough" insert -- and --.
Lines 24-25, delete the words "be concentric with" and insert in place thereof -- define --.
Lines 25-28, after "aperture," delete "wherein the fastener includes a plurality of penetrating members and further wherein each penetrating member pierces the backing plate from the grinding surface side,"

UNITED STATES PATENT AND TRADEMARK OFFICE

CERTIFICATE OF CORRECTION

PATENT NO. : 6,863,596 B2
DATED : March 8, 2005
INVENTOR(S) : Fritz, Peter J.

It is certified that error appears in the above-identified patent and that said Letters Patent is hereby corrected as shown below:

Column 17,
Line 9, after "shaft;" insert -- and --.

Signed and Sealed this

Fourteenth Day of June, 2005

JON W. DUDAS
*Director of the United States Patent and Trademark Office*